US006179235B1

(12) United States Patent
King

(10) Patent No.: US 6,179,235 B1
(45) Date of Patent: Jan. 30, 2001

(54) COLLASPE RESISTANT CENTER FEED ROLL AND PROCESS OF MAKING THEREOF

(75) Inventor: Timothy James King, Moss (GB)

(73) Assignee: Kimberly-Clark Limited, Northop (GB)

( * ) Notice: Under 35 U.S.C. 154(b), the term of this patent shall be extended for 0 days.

(21) Appl. No.: 09/144,421

(22) Filed: Aug. 31, 1998

(51) Int. Cl.[7] ..... B65H 18/28; B65H 19/28
(52) U.S. Cl. ..... 242/160.1; 242/520; 242/532.3
(58) Field of Search ..... 242/520, 160, 242/160.1, 532.3

(56) References Cited

U.S. PATENT DOCUMENTS

| | | | | |
|---|---|---|---|---|
| 3,823,887 | | 7/1974 | Gerstein | 242/56.2 |
| 3,853,279 | | 12/1974 | Gerstein | 242/56.2 |
| 4,487,378 | | 12/1984 | Kobayashi | 242/68 |
| 5,271,575 | | 12/1993 | Weinert | 242/67.1 R |
| 5,281,386 | | 1/1994 | Weinert | 264/512 |
| 5,453,070 | | 9/1995 | Moody | 493/288 |
| 5,467,936 | * | 11/1995 | Moody | 242/532.3 |
| 5,518,200 | | 5/1996 | Kaji et al. | 242/538.1 |
| 5,620,148 | | 4/1997 | Mitchell | 242/160.4 |
| 5,722,608 | | 3/1998 | Yamazaki | 242/160.1 |
| 5,746,379 | * | 5/1998 | Shimizu | 242/532.3 |
| 5,849,357 | * | 12/1998 | Andersson | 242/532.3 |

* cited by examiner

*Primary Examiner*—John Q. Nguyen
(74) *Attorney, Agent, or Firm*—Karl V. Sidor

(57) ABSTRACT

The center feed roll may include a wound sheet material having lessened wound tension due to exposure to moisture. This exposure may prevent the inward collapse of sheet material into the core of the center feed roll.

15 Claims, 3 Drawing Sheets

COLLASPE RESISTANT CENTER FEED ROLL AND PROCESS OF MAKING THEREOF

FIELD OF THE INVENTION

This invention generally relates to the field of paper making, and more specifically, to paper rolls.

BACKGROUND

Generally, center feed rolls are used to dispense sheet material, such as paper hand towels or toilet tissues. Desirably, center feed rolls dispense material from their center rather than their periphery, as opposed to conventional rolls. During dispensing, the roll housed in a dispenser may be stationary as material is removed from its core.

Unfortunately, sometimes a center feed roll collapses inward towards its core during dispensing. In some cases, the collapsed material clogs the dispenser opening and prevents further dispensing. As a result, the dispenser is inoperable until the collapsed roll, which often must be disposed, is replaced.

Accordingly, there is a need for a center feed roll that resists core collapse thereby improving operability and reducing waste.

DEFINITIONS

As used herein, the term "comprises" refers to a part or parts of a whole, but does not exclude other parts. That is, the term "comprises" is open language that requires the presence of the recited element or structure or its equivalent, but does not exclude the presence of other elements or structures. The term "comprises" has the same meaning and is interchangeable with the terms "includes" and "has".

The term "machine direction" as used herein refers to the direction of travel of the forming surface onto which fibers are deposited during formation of a material.

The term "cross-machine direction" as used herein refers to the direction, which is perpendicular and in the same plane as the machine direction.

As used herein, the term "cellulose" refers to a natural carbohydrate high polymer (polysaccharide) having the chemical formula $(C_5H_{10}O_5)_n$ and consisting of anhydroglucose units joined by an oxygen linkage to form long molecular chains that are essentially linear. Natural sources of cellulose include deciduous and coniferous trees, cotton, flax, esparto grass, milkweed, straw, jute, hemp, and bagasse.

As used herein, the term "pulp" refers to processed cellulose by such treatments as, for example, thermal, chemical and/or mechanical treatments.

As used herein, the term "nonwoven web" refers to a web that has a structure of individual fibers which are interlaid forming a matrix, but not in an identifiable repeating manner. Nonwoven webs have been, in the past, formed by a variety of processes known to those skilled in the art such as, for example, meltblowing, spunbonding, wet-forming and various bonded carded web processes.

As used herein, the term "moisture" refers to a liquid, desirably aqueous, diffused or condensed in a relatively small quantity.

As used herein, the term "basis weight" (hereinafter may be referred to as "BW") is the weight per unit area of a sample and may be reported as gram per meter squared and abbreviated "gsm".

As used herein, the term "roll core" refers to the hollow region at the axis of a center feed roll. This region increases in size as sheet material is dispensed from the roll.

SUMMARY OF THE INVENTION

The problems and needs described above are addressed by the present invention, which provides a center feed roll. The center feed roll may include a wound sheet material having lessened wound tension due to exposure to moisture. This exposure may prevent the inward collapse of sheet material into the core of the center feed roll. Furthermore, the center feed roll may be exposed to humidity thereby increasing the moisture in the center feed roll. Moreover, the moisture may be applied by spraying a liquid. In addition, the liquid may be water, a starch solution, or an adhesive solution. Also, an effective amount of water may be added to the center feed roll for preventing the roll from collapsing inward.

A further embodiment of the present invention is a process for making a center feed roll collapse resistant. The process may include the steps of providing a center feed roll having rolled sheet material and exposing the rolled sheet material to moisture. Afterwards, the sheet material may release wound potential energy thereby lessening tension within the center feed roll and preventing the collapsing of the center feed roll during dispensing. Furthermore, exposing the rolled sheet material to moisture may further include spraying liquid on at least one end of the center feed roll. Moreover, both ends of the center feed roll may be sprayed with liquid. Also, the liquid may be water, a starch solution, or an adhesive solution. What is more, an effective amount of water may be sprayed on each end of the center feed roll. Alternatively, moisture may be added to the center feed roll by exposing the roll to humidity. Still a further alternative, moisture may be added to the center feed roll during winding of the sheet material. Optionally, the moisture may be sprayed onto the edges of the sheet material while being formed into a center feed roll.

DETAILED DESCRIPTION OF THE PREFERRED EMBODIMENT(S)

Figure 1:
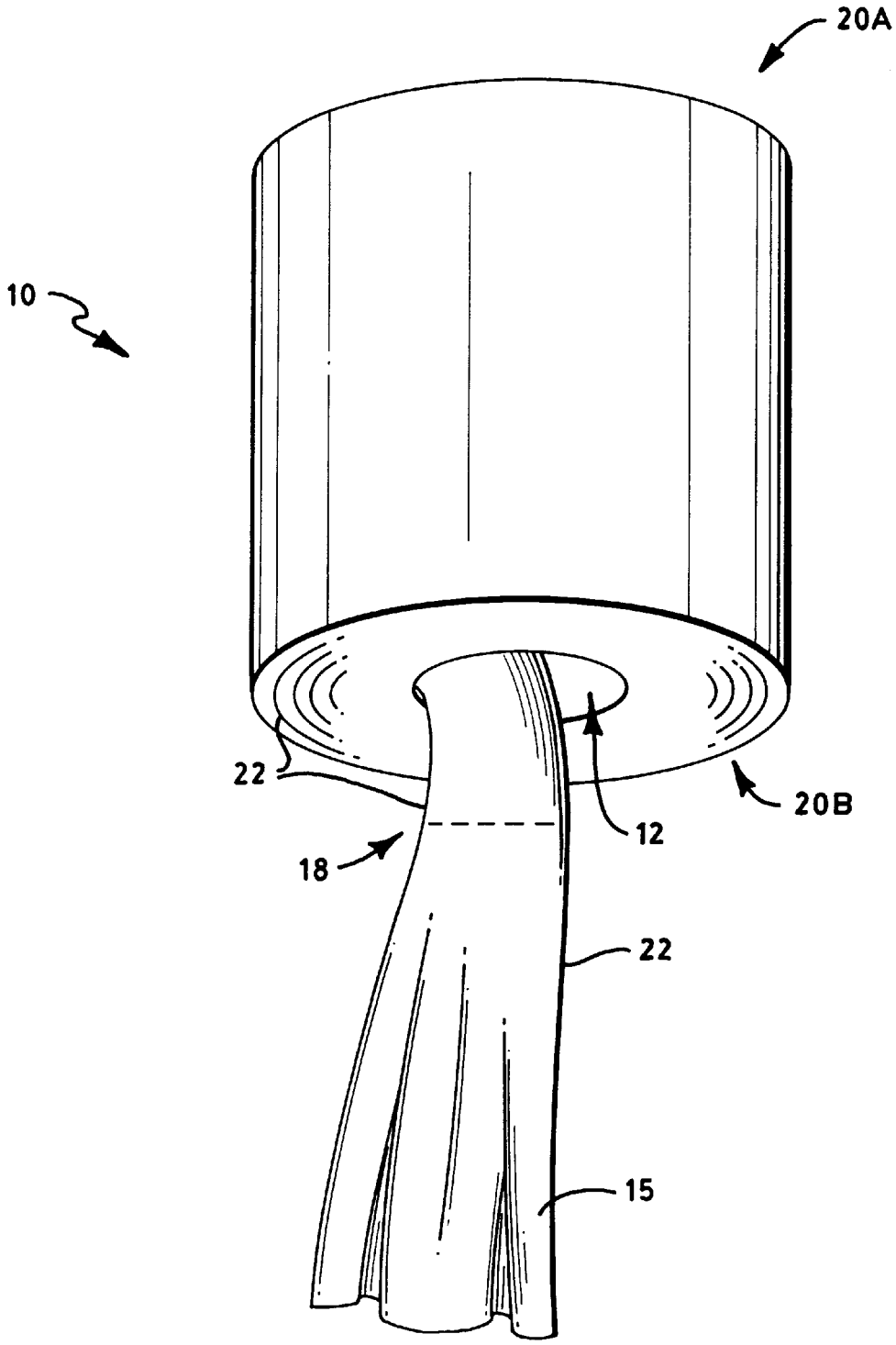
FIG. 1 is a perspective view of a center feed roll with a portion of sheet material dispensed from its center.

Referring now to the drawings, wherein like reference numerals designate corresponding structure throughout the views, and referring in particular to FIG. 1, there is depicted a partially dispensed center feed roll 10 desirably having wound sheet material 15 forming a hollow core 12. Desirably during the manufacture of the roll 10, the sheet material 15 is wound around a mandrel, which may be a perforated, helical cardboard center 14 hereinafter described and depicted in FIGS. 2–3. This center 14 facilitates the winding of the sheet material 15 and is removed to begin dispensing. Thus, the removal of the center leaves a hollow core similar to the one depicted in FIG. 1.

The sheet material 15 depicted as partially dispensed may have perforations 18 dividing the sheet material 15 into segments, which may be torn for use. Also, the sheet material 15 may have edges 22, while the roll 10 may further include substantially circular ends 20A–B.

The roll 10 may be configured either substantially vertical as depicted in FIG. 1 or substantially horizontal during dispensing. The roll 10 may be from about 8 centimeter (cm) to about 46 cm wide and from about 8 cm to about 46 cm in diameter. Desirably, the roll is about 20 cm wide and about 20 cm in diameter. Furthermore, the sheet material 15 in the roll 10 may have a basis weight from about 15 gsm to about 50 gsm. Desirably, the sheet material 15 in the roll 10 has a basis weight of about 32 gsm.

Generally, the roll 10 is constructed from cellulose, and optionally, may include some nonwoven materials. The sheet material may have a machine direction stretch greater than about 30 percent. The machine direction stretch is the percent a material will stretch at its breaking point over its length when taunt.

Desirably, moisture is added to the roll 10. Although the inventor should not be held to any theory, it is believed that added moisture interacts with the cellulose fiber bonds in the paper, thereby releasing potential energy created during the winding of the roll 10. As a result, the tension in the roll 10 relaxes, particularly those rolls having a machine direction stretch greater than 30 percent. This relaxation stabilizes the core region during dispensing and prevents the inward collapse of the roll 10.

Moisture may be added to the ends 20A–B outside the center 14, to the center 14, or to the entirety of the roll 10. This moisture may be added after the roll 10 is formed or along the edges 22 of the sheet material 15 during winding when forming the roll 10. The moisture may be applied by spraying, sponging, dipping, or coating. Alternatively, the moisture may be applied by humidifying the roll 10 over several weeks. As an example, storing the roll 10 at least about 50 percent humidity for about 4–6 weeks may add sufficient moisture to prevent core collapse during dispensing.

The moisture may be water, starch solutions, or adhesive solutions. Desirably, ordinary tap water is applied to the roll 10 in an effective amount to prevent the inward collapse of the roll 10. The amount of moisture applied to the roll 10 may range from about 0.0031 grams of moisture per 1.0 gram of roll 10 to about 1.0 grams of moisture per 1.0 gram of roll 10. Desirably, the amount of moisture applied to the roll 10 may range from about 0.013 grams of moisture per 1.0 gram of roll 10 to about 0.05 grams of moisture per 1.0 gram of roll 10. More desirably, the amount of moisture applied to the roll 10 is about 0.025 grams.

Figure 2:
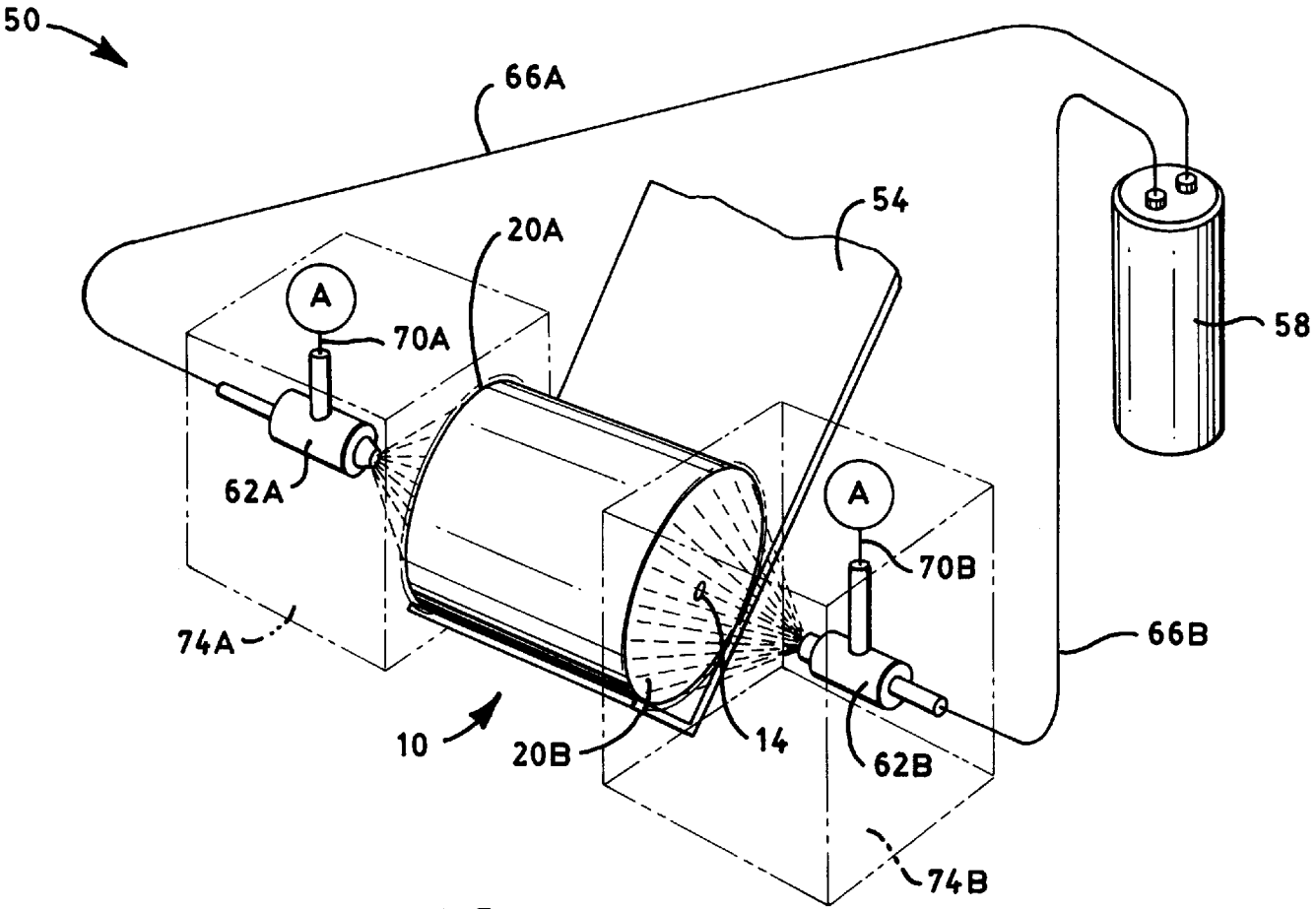
FIG. 2 is a perspective view of an exemplary process for making a center feed roll collapse resistant.
Figure 3:
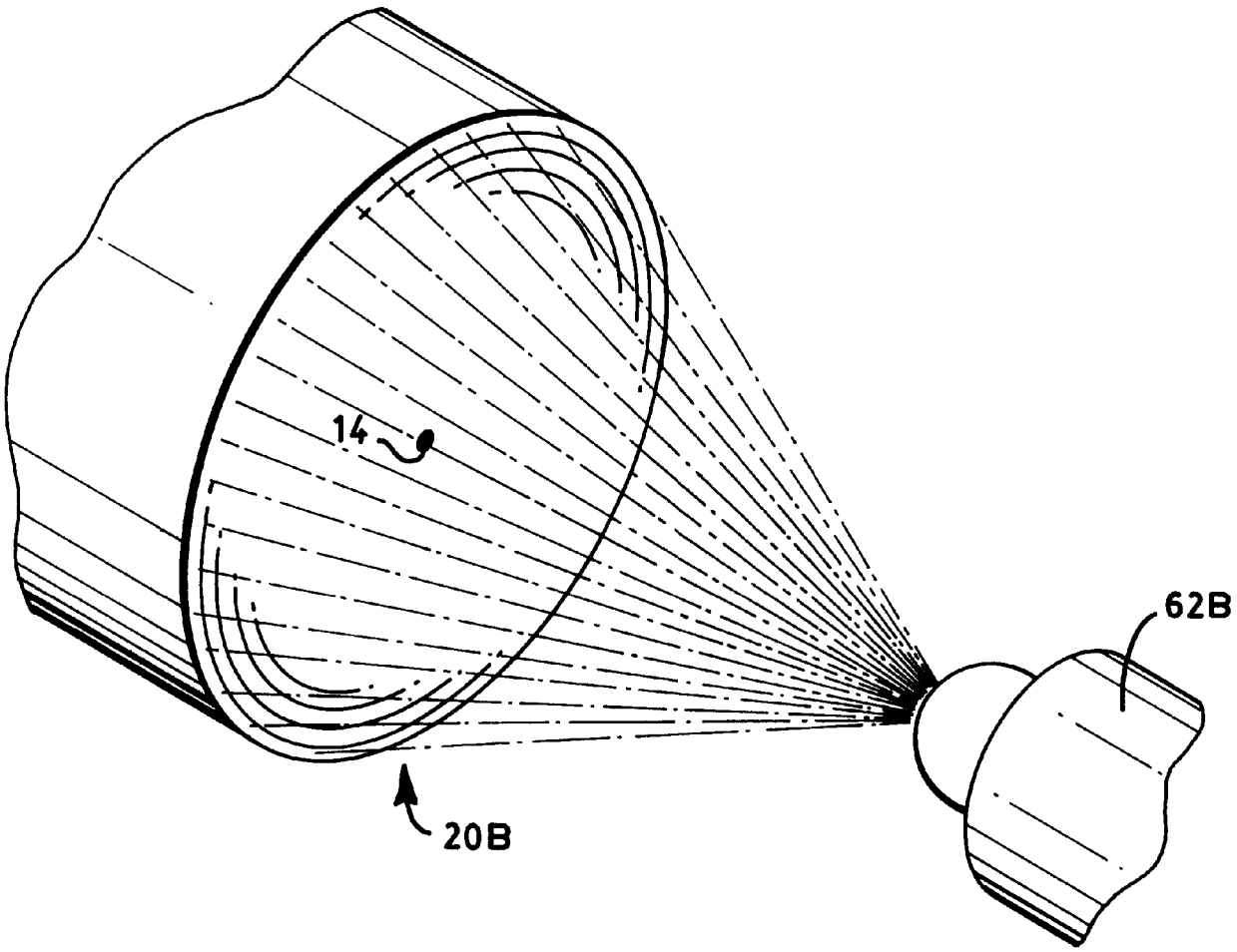
FIG. 3 is a close-up, perspective view of a sprayer applying water to the end of a center feed roll.

An exemplary process 50 for adding moisture to a center feed roll 10 is depicted in FIGS. 2 and 3. The process 50 may include a chute 54, a pressurized water cylinder 58, sprayers 62A–B, water lines 66A–B, air lines 70A–B, and shields 74A–B. Desirably, the chute 54 positions a center feed roll 10 having a solid, cardboard center 14 between the two sprayers 62A–B. The roll 10 having about 32 gsm sheet material 15 and a mass of about 1.6 kilogram may have a width of 20 cm and a diameter of 20 cm.

The water cylinder 58 may communicate with a pressurized air source (not shown). Water from the cylinder 58 ranging in pressure from about 70,000 Pascals to about 400,000 Pascals may be supplied through lines 66A–B to respective sprayers 62A–B. Also, pressurized air ranging in pressure from about 110,000 Pascals to about 700,000 Pascals is supplied through lines 70A–B to respective sprayers 62A–B. Desirably, the sprayers 62A–B apply water to the sides of the roll 10, but not its center 14. Applying water to the center 14 may loosen the adhesives in the cardboard center 14 and result in its buckling. Commonly available commercial sprayers may be used, but one desirable sprayer is sold under the trade designation SU-30 by Spraying Systems Company of Wheaton, Ill.

Desirably, a total of about 40 grams of water is added per roll 10. As a result, about 20 grams of water may be applied to each end 20A–B of the roll 10. Optionally, shields 74A–Bare present to contain moisture and to minimize slip hazards around the chute 54. Once sprayed, the roll 10 may be removed from the chute 54. It is expected that the roll 10 having about an 80 mm core 12 would not collapse any more than about 5 mm after having been stored about 7 days. Although this process 50 has been described, one of ordinary skill in the art will readily recognize other alternatives of applying moisture to the roll 10.

DETERMINATION OF PROPERTIES

The following method may be used to determine basis weight, which is the unit weight per area of sample. The equipment used may be a circular precision cutter and an electronic balance capable of accurately weighing to 0.001 grams. Five samples may be prepared by using the circular cutter taking care to avoid any folds, wrinkles, or creases. The samples are cut having a an area of 100 square centimeters. Desirably, samples are conditioned at laboratory conditions of about 22 degrees Celsius and about 50 percent relative humidity for 24 hours. The procedure entails placing each sample on the balance and recording the weight to three decimal places. The calculations are made by multiplying the weight by 100 to give results in grams per square meter. The mean and standard deviation for the 5 readings may be calculated to 1 decimal place.

COMPARATIVE TESTING

Four sets of center feed rolls having an initial core diameter of about 80 millimeters were made from same sheet material, namely wood pulp, having a basis weight of about 32 gsm, a mass of about 1.6 kilograms, and a machine direction stretch of about 20 percent. The sheet material forming these rolls was wound at about the same tension resulting in about 760 sheet segments per roll. These sheet segments were separated by perforations and may be used as hand towels for wiping up liquids.

Three sets were sprayed with about 20 to about 30 grams of tap water while one set was not sprayed. Each of the three sets having added water were sprayed at varying locations as depicted in Table 1.

TABLE 1

| Roll Number | Location of Added Moisture |
|---|---|
| 1 | None |
| 2 | Sprayed To Both Sides Of The Roll Outside the Center |
| 3 | Sprayed To The Sides Of The Sheet Material As Being Wound Around Cardboard Center To Form Roll |
| 4 | Sprayed To Both Sides Of the Roll At The Cardboard Center |

After manufacture, and if applicable spraying, rolls in all four sets were wrapped with polyethylene preventing atmospheric moisture from penetrating the rolls. After four weeks, the rolls were unwrapped, had their cardboard helical center removed, and allowed to sit for ten minutes. Afterwards, the core collapse of the rolls was assessed by measuring the shortest diameter on each side of the roll. Thus, each tested roll had two diameter measurements.

Table 2 compares the average diameter Rolls 2–4 with added moisture versus Roll 1 without added moisture.

TABLE 2

| | Roll 1 | Roll 2 | Roll 3 | Roll 4 |
|---|---|---|---|---|
| AVERAGE DIAMETER (millimeter) | 54 | 67 | 67 | 73 |
| STANARD DEVIATION (millimeter) | 10 | 7 | 10 | 4 |
| NUMBER OF ROLLS | 5 | 5 | 4 | 1 |
| NUMBER OF MEASUREMENTS | 10 | 10 | 8 | 2 |

As depicted in Table 2, Rolls 2–4 had a greater average diameter than Roll 1, thereby exhibiting less collapse. Thus, adding moisture to Rolls 2–4 reduced the amount of sheet material collapsing into the core of the roll after four weeks.

Another set of rolls having about the same properties and made under substantially the same set of conditions as Rolls 1–4 were tested. No moisture was added to these rolls. Some of these rolls were wrapped while others were not. After four weeks, the rolls were unwrapped, had their cardboard helical center removed, and allowed to sit for ten minutes. Afterwards, the core collapse of the rolls was assessed by measuring the shortest diameter on each side of the roll. Thus, each tested roll had two diameter measurements.

Properties of these rolls, which included Roll 3, are depicted in Table 3:

TABLE 3

| Roll Number | Initial Core (millimeter) | Diameter Wrapped | Basis Weight (GSM) |
|---|---|---|---|
| Roll 5 | 60 | Yes | 32 |
| Roll 6 | 60 | No | 32 |
| Roll 3 | 80 | Yes | 32 |
| Roll 7 | 80 | No | 32 |
| Roll 8 | 60 | Yes | 40 |
| Roll 9 | 60 | No | 40 |
| Roll 10 | 80 | Yes | 40 |
| Roll 11 | 80 | No | 40 |

As previously mentioned, the wrapping on some of these samples prevented atmospheric moisture from reaching the center feed rolls. The humidity was approximately 50 percent for four weeks. Table 4 compares the average diameters of wrapped and unwrapped rolls.

TABLE 4

| Roll Number | 5 | 6 | 3 | 7 | 8 | 9 | 10 | 11 |
|---|---|---|---|---|---|---|---|---|
| AVERAGE DIAMETER (millimeter) | 46 | 51 | 54 | 58 | 50 | 54 | 49 | 59 |
| STANDARD DEVIATION (millimeter) | 7 | 8 | 10 | 6 | 4 | 3 | 9 | 12 |
| NUMBER OF ROLLS | 4 | 4 | 5 | 5 | 3 | 3 | 6 | 5 |
| NUMBER OF MEASUREMENTS | 8 | 8 | 10 | 10 | 6 | 6 | 12 | 10 |

Comparing Rolls 5 and 6, 3 and 7, 8 and 9, and 10 and 11, where the only significant difference between these pairs is the presence or lack of wrapping, the unwrapped Rolls 6, 7, 9 and 11 have slightly greater diameters than Rolls 5, 3, 8 and 10. Thus, these rolls exhibit slightly less collapse than rolls sealed with wrapping. It is believed that the unwrapped rolls were exposed to humidity while the wrapped rolls were not. This exposure resulted in moisture being added to the unwrapped rolls, and thereby reducing the amount of sheet material collapsing into the core of the roll.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

What is claimed is:

1. A coreless, collapse-resistant center feed roll comprising cellulosic sheet material wound into a roll along a central axis, the roll having:

a circumferential outer surface; and a first end and a second end, each end being composed of edges of the sheet material and defining an opening that extends through the roll along the central axis as a hollow inner core, so the sheet material at the hollow core is adapted to dispense from the roll through one of the openings while the roll remains stationary, wherein the roll includes at least one region where cellulosic sheet material of the roll is stiffened by adding an aqueous liquid to at least one end of the roll away from the hollow inner core and allowing the material to dry to reduce the likelihood that sheet material will collapse into the hollow inner core during dispensing of sheet material through one of the openings.

2. The coreless, collapse-resistant center feed roll of claim 1 wherein aqueous liquid is applied to at least one end of the roll away from the hollow inner core during formation of the roll.

3. The coreless, collapse-resistant center feed roll of claim 1 wherein the aqueous liquid is applied by spraying a liquid.

4. The coreless, collapse-resistant center feed roll of claim 3 wherein the liquid is water.

5. The coreless, collapse-resistant center feed roll of claim 3 wherein the liquid is a starch solution.

6. The coreless, collapse-resistant center feed roll of claim 3 wherein the liquid is an adhesive solution.

7. A process for making a coreless, collapse-resistant center feed roll comprising the steps of;

winding a cellulosic sheet material into a roll along a central axis, the roll having.

a circumferential outer surface; and a first end and a second end, each end being composed of edges of the sheet material and defining an opening that extends through the roll along the central axis as a hollow inner core, so the sheet material at the hollow inner core is adapted to dispense from the roll through one of the openings while the roll remains stationary; and adding an aqueous liquid to at least one end of the roll away from the hollow inner core and allowing the material to dry so the sheet material is stiffened to reduce the likelihood that sheet material will collapse into the hollow inner core during dispensing of sheet material through one of the openings.

8. The process of claim 7 wherein adding an aqueous liquid to at least one end of the roll away from the hollow inner core further comprises spraying liquid on at least one end of the center feed roll.

9. The process of claim 8 wherein adding an aqueous liquid to at least one end of the roll away from the hollow inner core further comprises spraying liquid on both ends of the center feed roll.

10. The process of claim 9 wherein the liquid is an adhesive solution.

11. The process of claim 9 wherein the liquid is water.

12. The process of claim 9 wherein the liquid is a starch solution.

13. The process of claim 7 wherein aqueous liquid is applied to at least one end of the roll away from the hollow inner core during formation of the roll.

14. The process of claim 13 wherein aqueous liquid is applied to at least one end of the roll away from the hollow inner core during the winding step.

15. The process of claim 14 wherein aqueous liquid is sprayed on at east one end of the roll away from the hollow inner core during the winding step.

* * * * *